United States Patent [19]

Hahn et al.

[11] 4,335,532

[45] Jun. 22, 1982

[54] EXCAVATING TOOTH

[75] Inventors: Frederick C. Hahn, Aloha; William R. Barber, Jr., Portland, both of Oreg.; David A. Hampel, Vancouver, Wash.

[73] Assignee: ESCO Corporation, Portland, Oreg.

[21] Appl. No.: 235,771

[22] Filed: Feb. 25, 1981

Related U.S. Application Data

[63] Continuation-in-part of Ser. No. 144,368, Apr. 28, 1980, abandoned.

[51] Int. Cl.[3] ..... E02F 9/28

[52] U.S. Cl. ..... 37/142 R; 299/91

[58] Field of Search ..... 37/141 R, 141 T, 142 R, 37/142 A; 299/91, 92

[56] References Cited

U.S. PATENT DOCUMENTS

| | | | |
|---|---|---|---|
| 329,545 | 11/1885 | Foley | 37/142 R |
| 784,116 | 3/1905 | McCaskey | 37/142 R |
| 1,656,511 | 1/1928 | Dahl | 37/142 R |
| 2,145,663 | 1/1939 | Reynolds | 37/141 T |
| 3,117,386 | 1/1964 | Ferwerda | 37/142 R |
| 3,144,909 | 8/1964 | Hart et al. | 37/142 A |
| 3,690,728 | 9/1972 | Krekeler | 37/142 A |
| 3,833,264 | 9/1974 | Elders | 37/142 A |

FOREIGN PATENT DOCUMENTS

| | | | |
|---|---|---|---|
| 390476 | 2/1924 | Fed. Rep. of Germany | 37/142 R |
| 2162474 | 6/1973 | Fed. Rep. of Germany | 37/142 R |

*Primary Examiner*—E. H. Eickholt

*Attorney, Agent, or Firm*—Tilton, Fallon, Lungmus & Chestnut

[57] ABSTRACT

An excavating tooth wherein the coupling between the point and the adapter is achieved through generally helical thread means with an external lock to prevent removal by reverse rotation relative to the direction of the helical thread means.

35 Claims, 11 Drawing Figures

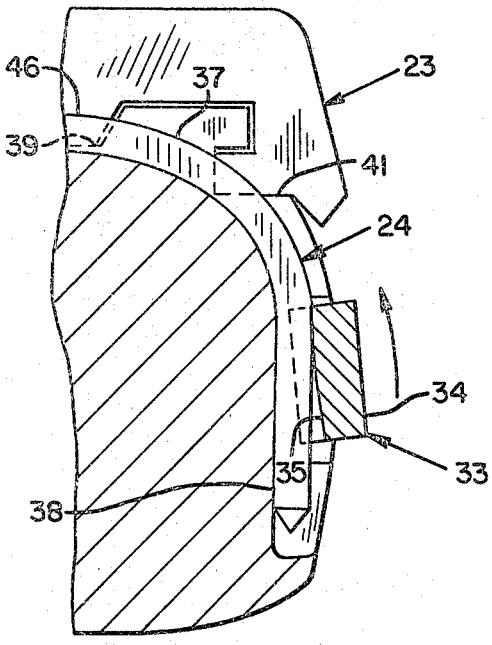
FIG. 3
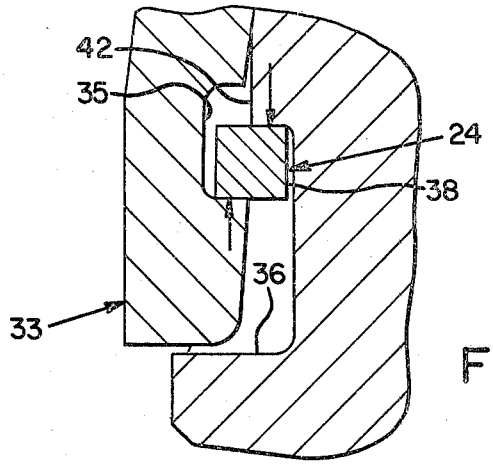
FIG. 4
FIG. 5
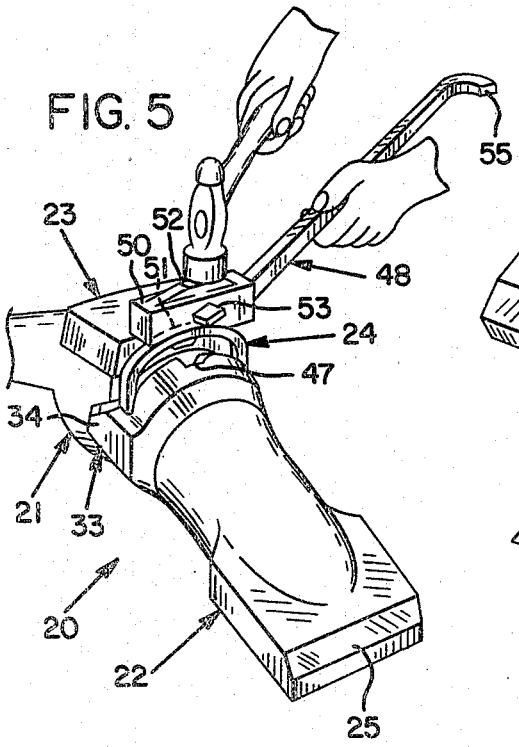
FIG. 6
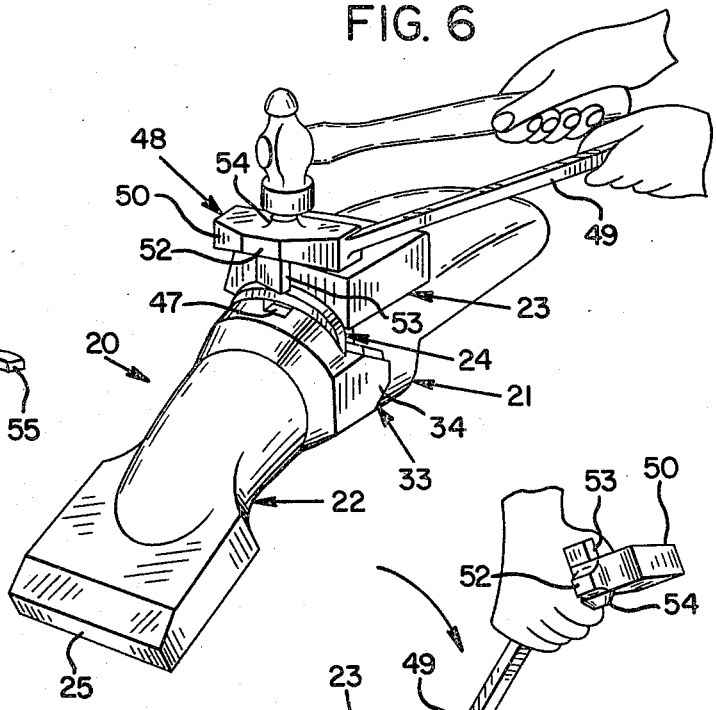
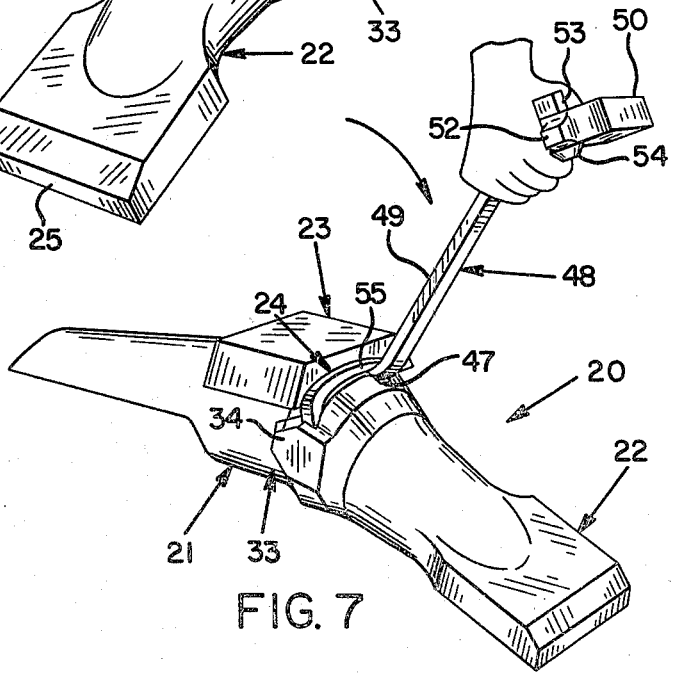
FIG. 7

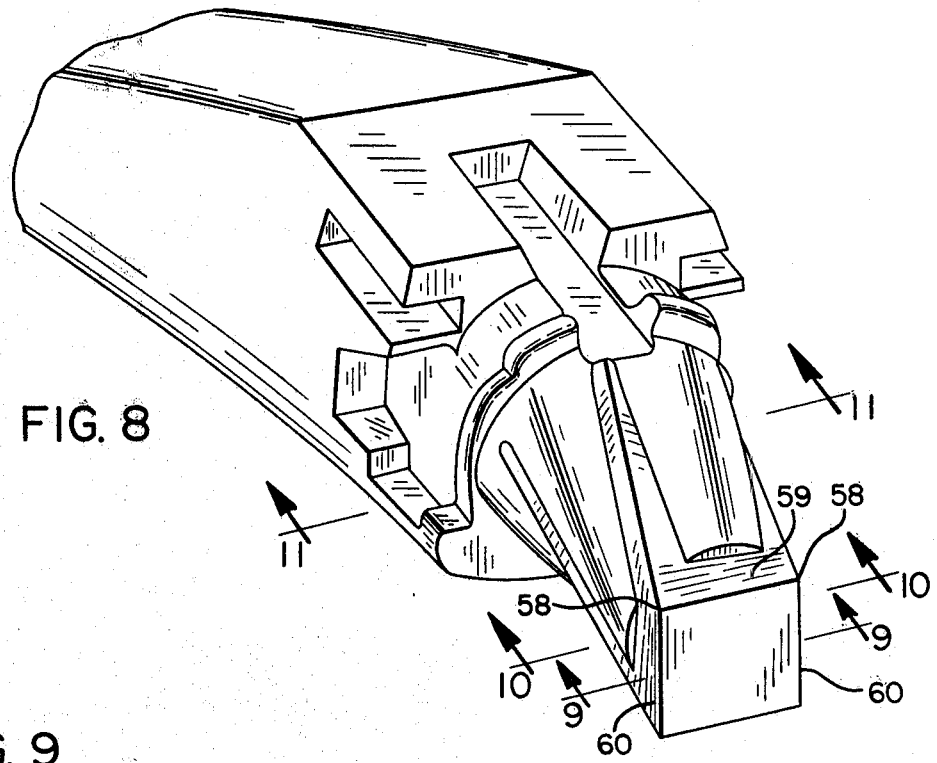
FIG. 8
FIG. 9
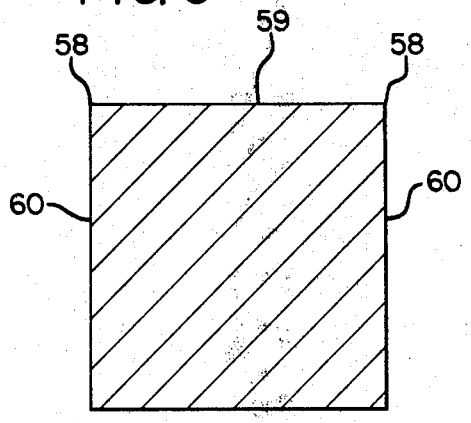
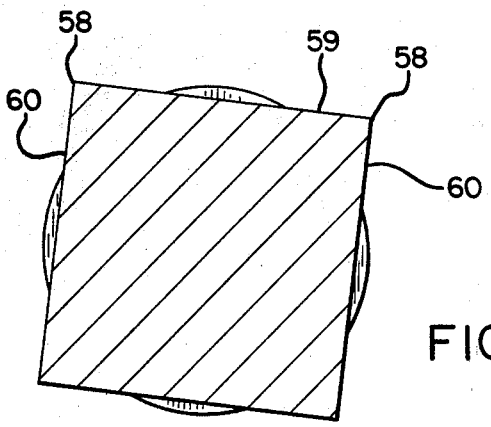
FIG. 10
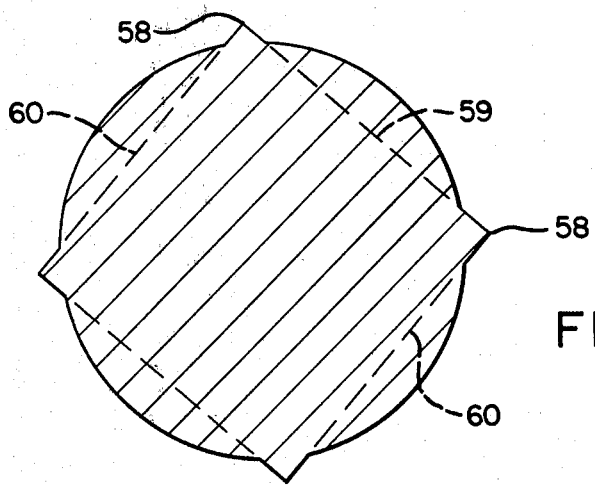
FIG. 11

EXCAVATING TOOTH

This invention is a continuation-in-part of our copending application Ser. No. 144,368, filed Apr. 28, 1980, now abandoned.

BACKGROUND AND SUMMARY OF INVENTION

This invention relates to an excavating tooth and, more particularly, to an excavating tooth having a unique connection between the point and adapter. As such, the invention relates to two-part teeth. At about the turn of the century, workers in the excavating art saw the merit of providing replaceable tips, viz., "points" on the tooth shank or adapter, so as to renew the penetrating portion without expensive downtime—see, for example, U.S. Pat. No. 564,664.

Over the years, many ways have been developed for mounting the point on the adapter—although, for the most part, these have taken the form of a wedge-shaped socket at the rear of the point which received a correspondingly shaped nose on the adapter. Almost at the outset of two-part teeth, it was seen to be possible to screw the adapter nose into a threaded socket in the point—see U.S. Pat. No. 784,116. However, notwithstanding the manifestly greater gripping power of a threaded connection, no commercial use of this has occurred during the last three-quarters of a century. In fact, the only teaching found of a threaded coupling for a point and adapter was in U.S. Pat. No. 2,145,663 issued in 1939. So for the past forty years no one has seen fit to utilize on the threaded connection.

It is surmised that one reason for this is the fact that the threads in the coupling really contributed nothing to the attachment—the principal securing means in U.S. Pat. No. 2,145,663 being a locking pin extending through the usual aligned openings in the point walls and adapter nose. A lock of some kind was essential to resist an unscrewing force. So notwithstanding the fact that a tightening force could be adequately resisted by the helical threads alone, these were ineffective when an unscrewing force was applied. This, in a practical sense the threads were superfluous.

It should be appreciated that the forces encountered by excavating teeth vary widely in direction location and magnitude. Because the consequences of a lost coupling are all out of proportion to the cost of the coupling—downtime of expensive equipment and repair in the primitive conditions of the field—locks and couplings have been engineered to stand up under the extraordinary and infrequently encountered force. Thus, a tooth that had a vulnerability to a force of one kind even though it possessed great strength to the opposite force, was manifestly unacceptable—except that a staunch lock be provided, and then the art was no better off than before.

According to the instant invention, a significant improvement has been made in the excavating tooth art by the combination of a helical thread coupling with a lock external to the coupling. An immediate advantage accuring from this arrangement is that the adapter nose can be solid, i.e., the heretofore commonplace locking pin opening is eliminated. It is in the area of the pin opening that most nose failures occur—so that art workers have had to "beef-up" this portion of the nose. Normally, the lock opening is positioned near the shoulder which joins the nose to the relatively massive adapter shank so that this has been an additional concern—providing an area of weakness immediately adjacent an area of transition, classically an area of incipient failure in itself. However, the wedge or tapered shape of the nose—dictated by the need for easy assembly and proper performance—also dictated that the pin opening be as rearward as possible so as to be in the section of greatest area, hence, strength. But, as pointed out just above, this intruded on the classically weak area of transition and aggravated the weakness.

However, by utilizing a solid threaded nose as the coupling means with the lock external thereto, the adapter is strengthened to such an extent that, according to preliminary tests, the rupture resistance of the nose in the inventive tooth is that of a conventional tooth one or two sizes larger, i.e., 20% stronger than the comparable prior art tooth of the same size. For example, teeth are generally sized according to the horizontal dimension across the rear of the point, expressed in inches—so the inventive tooth has the strength of a conventional tooth ½"-2" wider.

The provision of the external lock in combination with the threaded coupling provides a second and equally desirable advantage—the shear forces normally applied to the locking pin are converted to compressive forces so that a much smaller pin is used, again resulting in better use of the available metal in the tooth. It will be appreciated that in past teeth (whether of the type disassembled by unscrewing or just translation of the point) an impact tending to remove the point resulted in shearing forces at the ends of the locking pin. In other words, the movement of the inside of the point relative to the outside of the nose tended to shear the pin in the plane of movement. However, with the inventive arrangement, the movement of the point in a twisting fashion applies the nominally shearing forces at points where the locking pin is bolstered against a portion of the adapter—so that what ordinarily would be a shearing force is converted to a compressive force. Thus, the force that in conventional teeth would tend to transversely sever the metal now tends to elongate the same—against which the metal has much greater resistance.

Historically, locking pins have extended vertically through the point and adapter so as to facilitate disassembly. Horizontal pins have been used but have uniformly been considered "knuckle-busters" because of the difficulty of access. This impedes one principal function of the lock—to be easily removable so as to permit quick replacement of the point. The other principal function is, of course, to keep the point firmly mounted on the adapter against inadvertent removal.

The invention achieves the beneficial results of the vertical pin locks of the past by using rearwardly extending tongues on the point sides to provide the means adapted to receiving vertical pins—so that at the same time the lock is not only lateral and rearward of the threaded coupling section but also able to receive a vertical pin. Even further, the provision of the tongues reduces further the stress to be resisted—by at least ½—because two locks are available without sacrificing valuable wear metal.

Although rearwardly extending tongues on points have long been used—see U.S. Pat. No. 2,483,032—they have not been used so far as is known to the inventors hereof for locking, rather only for secondary stabilization. In fact, the only disclosure known to the inventors hereof using an external lock is U.S. Pat. No. 2,666,272.

This, and co-owned U.S. Pat. No. 3,496,658, neither of which was employed commercially so far as known, are the only teachings where the aligned vertical lock openings were eliminated from the nose and point.

In the preferred form of the invention, an inverted U-shaped locking pin is employed which straddles the adapter and engages slots in the rearwardly extending tongues—thereby simultaneously achieving greater nose strength, the advantageous vertical removal while cooperating with the threads to avoid subjecting the pin to traditional transverse shearing in resisting unscrewing. Additionally the bight portion of the U-shaped pin is received within a transverse recess in the adapter top to protect the pin while providing means for such removal—and also while being located in the massive section of the adapter so as not to intrude into the areas of potential failure described above.

In the instance where a heavy impact load is concentrated near the tip of the tooth, it is advantageous to provide additional means for secondary stabilization generally following the principle of U.S. Pat. No. 3,079,710. The structures used previously to provide such stabilization viz., "flats" on the nose and socket have been made much more useful per se in the inventive tooth. The rotational movement for installing and removing the point on the nose according to the invention develops satisfactory confronting beam bearing surfaces even though they are helically developed curves. This has been greatly aided through extending the nearly square-sided thread means out to the tip of the nose of the adapter and apex of the point socket while positioning them at the corners of the nose and socket apices.

These terminal portions of the thread means have been found to be advantageous cooperating with the "flats" of the stabilized nose and socket to prevent "peeling" of the point from the adapter upon the application of concentrated impact loads by developing more stabilized bearing surfaces in the critical area.

In the preferred embodiment the ribs or thread means are nearly square-sided and non-uniform in cross-section along their length—being larger adjacent the nose or socket tips or apices as they are nearly circumscribable (less draft) inside a cylinder but are reduced in size toward the rear due to inscribed conical nose.

Other advantages, both general and specific, of the invention can be appreciated as this specification proceeds.

The invention is described in conjunction with the accompanying drawing, in which—

FIG. 3 is a fragmentary sectional view showing the radial compressive force on the locking pin as along line 3—3;

FIG. 4 is a sectional view taken along the line 4—4 of FIG. 2;

FIG. 5 is a perspective view of the tooth in the process of assembly and featuring the role of a special tool;

FIG. 6 is another perspective view showing a subsequent step in assembly;

FIG. 7 is yet another perspective view showing the use of the tool in disassembly of the tooth;

FIG. 8 is a fragmentary perspective view of a modified form of nose according to the invention; and FIGS. 9–11 are sectional views taken along the lines 9—9, 10—10, and 11—11, respectively.

Figure 2:
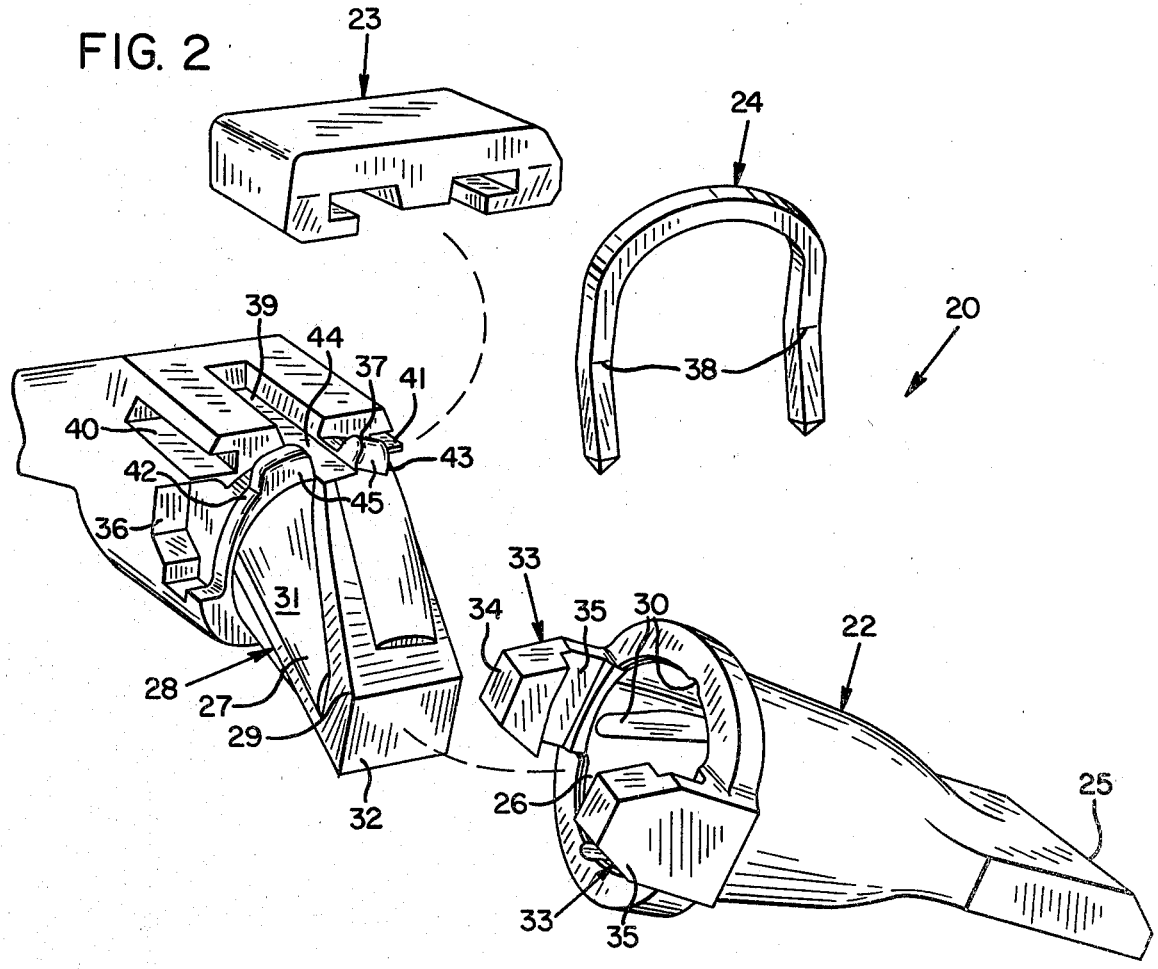
FIG. 2 is a perspective view in exploded form of the tooth of FIG. 1.

In the illustration given, the numeral 20 designates generally the inventive tooth assembly. As best seen in FIG. 2, the numeral 21 designates an adapter element while the numeral 22 designates the point element—the adapter 21 being seen only in fragmentary form inasmuch as a shank is usually provided for mounting the adapter onto the bucket lip, etc. Completing the combination are a wear cap 23 (optional) and a lock 24 in the form of an inverted U-shaped rod.

The point 22 has a digging or earth engaging edge or bit 25 at one end thereof and coupling means consisting of a socket 26 extending forwardly from the mounting end thereof. The adapter 21, in the illustration given, is equipped with a forwardly projecting nose part 27 which is adapted to be received within the socket 26.

Conventionally, the point is installed on the adapter by a lineal movement along the longitudinal center line or axis of the tooth.

In some instances, the nose and socket may be reversed—as where the mounting end of the point 22 is equipped with a shank very much like the nose 27 and the adapter is equipped with a socket much like the socket 26 and the point 22. However, the point is the element usually equipped with the socket because this is the element thrown away when worn or dull and it is advantageous to construction people, contractors, etc., to minimize the amount of throw-away metal.

The invention employs generally helical thread means at 28 for achieving the coupling between the point 22 and adapter 21. In the illustration given, the threads or helical flutes 28 are provided on the adapter nose 27 while the mating grooves 30 (see particularly FIG. 2) are provided on the interior of the socket 26. More particularly, a plurality of thread means (four or six to permit reversability) are provided in circumferentially-spaced relation about the nose 27 and in the socket 26 wherein each thread means extends only a minor portion of the circumference of the nose or socket, as the case may be. The major portion of the nose optimally is a surface of revolution generated about the longitudinal axis and thus may be conical as by generating the same by revolving a straight line inclined to the longitudinal axis or revolving another curve such as a parabola so as to develop optimum beam strength.

It will be appreciated that the male and female components of the thread means, i.e., the flutes 29 and grooves 30 may be interchanged between the nose and socket. However, as pointed out previously, the point is normally thrown away—the average life of an adapter being about that of five points—so that it is advantageous to minimize the metal in the point and therefore install the grooves therein.

Figure 1:
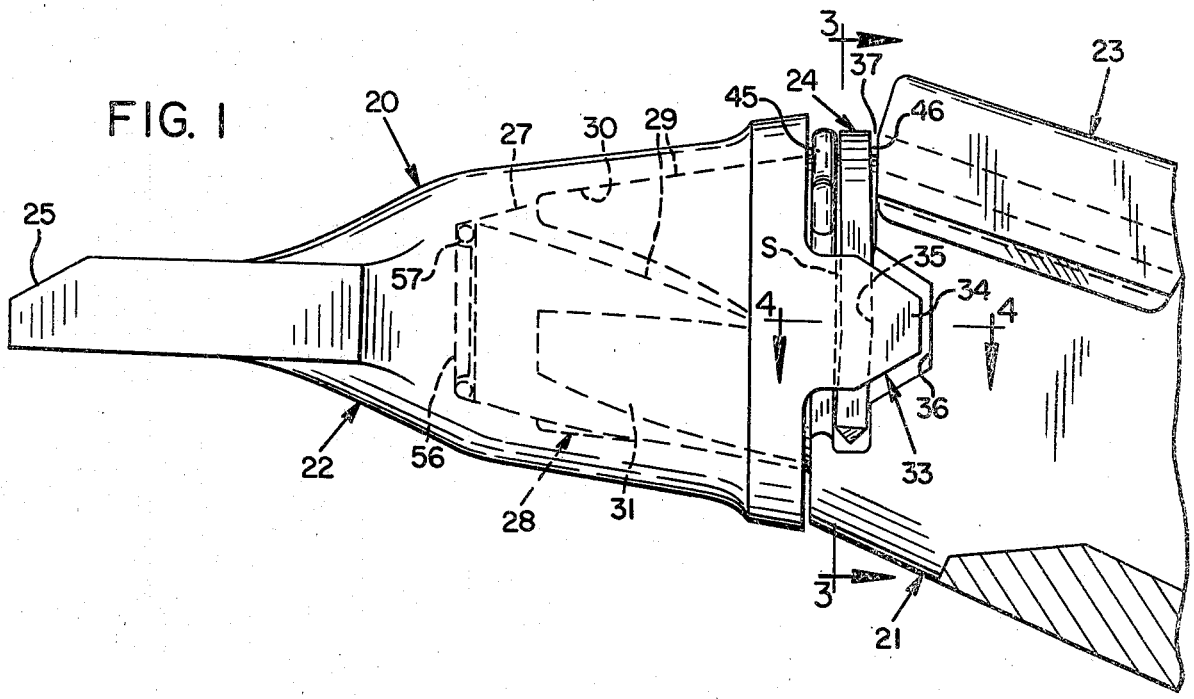
FIG. 1 is a side elevational view of a tooth embodying teachings of the instant invention.

By helical thread means, we mean a thread-like element which is developed by moving a point generally uniformly simultaneously circumferentially and axially on a surface of revolution. Thus, depending upon the respective velocities of movement in the two directions, steeper or shallower threads are developed. The numeral 31 (see FIGS. 1 and 2) designates the surfaces of revolution between the threads 29. At the forward end of the nose 27 as at 32 an area or section of stabilization is provided—generally as in U.S. Pat. No. 3,079,710 but differing therefrom in having beam bearing surfaces which are also generated about the longitudinal axis. Further, the angle of the nose in the surface of revolution area 31 relative to the axis is relatively shallow, of the order of 17°.

In the operation of the invention, the adapter is positioned with the forward end of the nose flutes 29 in alignment with the rear end of the point grooves 30 and installation is achieved by rotating the point 22 through approximately 45°. Thereafter the generally U-shaped lock 24 is insertable into the two side locking means 33. These consist of tongues or ears 34 extending rearwardly of the point 22 and having slots 35 therein—along with mating recesses 36 in the adapter to receive the tongues 34. The tongues 34 on the point 22 enter the recesses 36 at the last stage of point rotation mounting.

Because the point is constructed not to extend above the top surface of the adapter, the wear cap 23 can be installed on the adapter 21 either before or after the mounting of the point 22 thereon. It is only necessary to mount the wear cap 34 and point 22 on the adapter 21 before the lock 24 is installed.

The inverted U-shaped lock 24 is now installed—in the fashion depicted in FIGS. 5 and 6. For this purpose a transverse recess 37 is provided in the upper surface of the adapter. The lock 24 is held in place by slight deformation of the leg portions as at 38.

The upper surface of the adapter may be longitudinally slotted as at 39 for receipt of the central dovetail of the wear cap 23—while the adapter sides are slotted as at 40 and 41 to receive the rails or side flanges of the wear cap. The integral ring-like wall 45 just forward of the recess 37 is notched as at 42, 43 and 44 to accomodate passage of the side flanges and central dovetail, respectively of the wear cap 23. When the U-shaped lock 24 is installed, it bears against the forward end of the wear cap 23 as at 46 to lock the same in place. Thus, the lock 24 not only temporarily locks the point 22 on the adapter 21 but also performs the same function relative to the wear cap 23.

The lock 24 is constructed of resilient steel and because the legs are angled or deformed, some force is required to install the same in the transverse slot 37 and through the slots 35 in the tongues 34. This aids in keeping the point tight on the nose. To facilitate this force application, a special tool generally designated 48 is advantageously employed. The tool 48 has a handle portion 49 and a head portion 50. The head portion 50 is equipped with a recessed concave arcuate slot 51 conforming generally to the shape of the bight portion of the lock 24. The opposite side of the head portion 50 has a flat 52 to receive the impact of a hammer—this all being illustrated in FIG. 5. Once the lock 24 is driven substantially downward towards its seated position, the slot 51 is no longer effective—so that the tool 48 is then rotated 90° (to the configuration seen in FIG. 6). There is seen that a flange 53 on the head portion 50 is in engagement with the lock 24 and hammering on the boss 54—opposite the flange 53—drives the U-shaped lock to fully seated condition. The handle 49 has a pick end as at 55 useful in prying out the U-shaped lock 24 in the fashion depicted in FIG. 7 as at 47, further assisting the quick changing feature.

While the deformed lock provides tightness an optional method to achieve a tight fit between the point and adapter to annular groove 56 is provided at the apex of the socket 26 and an O-ring 57 of resilient material is installed therein. The provision of the annular groove 56 provides an advantageous function during manufacture because it constitutes a repository for the difficult-to-remove sand that normally occludes to casting corners. Thus, the adhering sand—on which considerable time has been spent in the past in removal—now can be substantially ignored and the groove later on serves as a place for inserting the O-ring 57.

The stabilized nose portion 32 in the 4.25 inch nominal tooth size (measured across the nose base) occupies the forward one inch of the 4.0 inch long nose—to that end the conical area of the nose extends generally over from about 60% to about 85% of the nose. In any event, the surfaces of revolution extend over a majority of the length of the nose, commencing from the rear thereof, i.e. the winglike wall 45.

Significantly, the threads 29 and grooves 30 extend over the nose length. The stabilizing section 32 is rectangular in transverse section. However, other shapes may be employed to advantage, viz., square, hexagonal, circular, etc. With the rectangular shape illustrated, the upper and lower beam bearing surfaces are more extensive while providing a slimmer profile to enhance penetrability. The threads or grooves, as the case may be are at the "corners" 58 of the stabilizing section 32, i.e., the intersections of the adjacent sides 59 and 60 of the nose apex, for example. The sides 59 (the upper and lower sides of the rectangular apex) are disposed generally perpendicular to the beam component of a force applied to the point—for greater detail see U.S. Pat. No. 3,079,710.

The beam bearing surfaces 59 are generated by revolving the rectangular section 32 about the longitudinal axis to provide a helical surface. This can be appreciated from a comparison of FIGS. 8–12 where a modified form of stabilizing section is shown—square as contrasted to rectangular in the first illustrated embodiment. As one proceeds rearwardly, the square or rectangular section becomes more and more twisted or skewed. Further, by placing the threads at the corners 58 (see FIG. 8) the skewing is used to advantage in merging the sides 159 and 160 into the threads—so that the threads serve as part of the beam bearing surfaces. Again, the threads and grooves are not of uniform cross-section as one proceeds rearwardly. The section area diminishes in proceeding rearwardly.

An alternative means for tightening the point on the adapter is to taper the legs of the U-shaped lock 24 as by forming them with a diminishing cross-section in proceeding downwardly—thereby developing a wedging action on installation.

In the operation of the invention, there is a unique cooperation between the helical coupling means and the external lock—one, for example, not achievable in the prior art U.S. Pat. No. 2,145,663. There the pin lock was located on the longitudinal centerline—so there was the disadvantage of weakening the nose near the critical shoulder area. Additionally, any point-unseating force—say a vertical force from above—tended to move the upper surface of the rearwardly extending nose forwardly while the lower surface moved rearwardly, creating the undesirable shearing action on the pin. This meant that if such a construction were used commercially, the pin would have to be enthickened so as to resist the shear—thereby requiring a larger nose opening and as a consequence further weakening the nose.

The inventive lock by virtue of being lateral of the longitudinal centerlne results in the pin being subjected to compression and shear in certain instances. In other words, the forces that normally would be applied in transverse shear and bending now are applied in a form of compression (See FIG. 3) but in other cases, depending upon the direction of magnitude of the applied force may be in longitudinal shear. The difference of a rod or pin in resisting these two different types of forces can be graphically illustrated by first putting a pencil on the edge of a table with a portion projecting beyond the table in cantilever fashion. It does not take a strong downward force on the overhanging end of the pencil to snap it off, i.e. from transverse shear. On the other hand, placing the pencil wholly on the table and subjecting it to the same downward force or in a longitudinal direction does nothing. In fact, a substantially greater force is needed to crush the pencil, i.e., to cause the fibres of the pencil to move longitudinally away from each side of the point of force application.

The conversion of the forces from acting in transverse shear and bending to those acting in compression is realized through the provision of the external lock. As the point is rotated under an unscrewing force, the tongues 34 move from their essentially vertical orientation to one that is inclined to the vertical—see FIG. 3. This results in the force near the bottom of the tongues 34 being a radially inward compressive force rather than a transverse shear force.

In somewhat analogous fashion, the rotation, i.e., unscrewing of the point moves the tongue 34 forwardly. This moves the lock 24 from its preloaded but generally low stressed condition to a condition where the deformed portion 62 is under a compressive stress—tending to straighten it out. So, again, what would have been a destructive transverse shear force is converted to a relatively benign longitudinal compressive force. The twisting action dictated by the helical thread coupling thus provides an entirely different phenomenon or coaction so that the lock thickness can be substantially reduced—and in the place the larger prior art pins occupied more tooth metal can be installed.

The novel operation of the pin lock is advantageous even under pure beam loading so that in some instances it can be used advantageously without the helical threads. By providing the deformed pin with an area for partial straightening, the pin is, in effect, preloaded so that before it reached what would be the shearing condition, the flats on the stabilized nose come into contact to prevent pin shearing.

The provision of the preloaded lock and the stabilizing section makes possible a variety of ways of resisting a force tending to remove the point from the adapter. First, it should be appreciated that there is great variability in the direction, location and magnitude of such forces. Second, there is great variability in the "fit" between the various parts. The point and adapter, being a manufactured product have tolerances—that even a subsequent point on the same adapter may fit completely differently.

According to the illustrated embodiment, there are three ways in which a point unseating force can be resisted and, according to preliminary testing, these generally occur in combination. First, the fit and external force vectors can result in twisting of the point resisted primarily by subjecting the pin to compression—as in FIG. 3. Second, the fit and force may cause the preloaded lock to operate within its preload—to enter the space S forward of the lock in FIG. 1—so that the stabilizing section 32 can provide the resistance. Third the fit and force may subject the lock to longitudinal shear. Although this type of resistance is known as in U.S. Pat. No. 3,774,324, for example, it was never modified or limited by the use of stabilizing means. Preliminary testing reveals that even the harshest impact loads—those concentrated at the tip and tending to unscrew the point result in a combination of the foregoing types of resistance.

Especially advantageous in resisting this type of loading is the combination of the thread means and the stabilizing surfaces. Because the threads are inscribed within a cylinder (save for the 2° draft required for pattern removal), there is a constant pitch diameter for the threads. Because the threads are circumscribed on the surfaces of revolution, i.e., the cone surfaces 31, there is a reduction in the thread projection or depth of groove as one proceeds rearwardly. This results in a concentration of the thread mass at the nose apex. The greater amount of exposed thread at the apex results under impact in a clinching action akin to that of a lock nut.

We claim:

1. An excavating tooth comprising an adapter element and a point element, said adapter element having means at one end for connection to a bucket or the like and means at the other end for coupling to said point element, said point element having an earth engaging edge at one end constituting the tooth forward end and means at the other end for coupling to said adapter element, said coupling means including a nose on one element and a nose receiving socket on the other element, a plurality of cooperating generally helical thread means on said nose and in said socket whereby said point element is rotated about a longitudinal axis to install the same on said adapter element, and lock means externally of said nose releasably connecting said elements to prevent reverse rotation of said point element when the same is installed on the said adapter element, said lock means being rearward of said nose and socket, said adapter element being equipped with said nose forward of a relatively massive section on said adapter and said point element being equipped with said socket, said lock means being positioned transverse to said longitudinal axis of said massive section.

2. An excavating tooth comprising an adapter element and a point element, said adapter element having means at one end for connection to a bucket or the like and means at the other end for coupling to said point element, said point element having an earth engaging edge at one end constituting the tooth forward end and means at the other end for coupling to said adapter element, said coupling means including a nose on one element and a nose receiving socket on the other element, a plurality of cooperating generally helical thread means on said nose and in said socket whereby said point element is rotated to install the same on said adapter element, and lock means externally of said nose releasably connecting said elements to prevent reverse rotation of said point element when the same is installed on the said adapter element, said lock means being rearward of said nose and socket, which said adapter element being equipped with said nose forward of a relatively massive section and said point element being equipped with said socket, said lock means being positioned in said massive section, which said lock means including interengaging parts on said point element and adapter element for receipt of locking rod means.

3. The structure of claim 2 in which said rod means includes a pair of pin means on opposite sides of said adapter.

4. The structure of claim 3 in which said rod means is a generally U-shaped fastener.

5. The structure of claim 4 in which said adapter element is equipped with a transverse recess rearward of said nose for accommodating the bight portion of said U-shaped fastener.

6. An excavating tooth comprising an adapter element and a point element, said adapter element having means at one end for connection to a bucket or the like and means at the other end for coupling to said point element, said point element having an earth engaging edge at one end constituting the tooth forward end and means at the other end for coupling to said adapter element, said coupling means including a nose on one element and a nose receiving socket on the other element, a plurality of cooperating generally helical thread means on said nose and in said socket whereby said point elment is rotated to install the same on said adapter element, and lock means externally of said nose releasably connecting said elements to prevent reverse rotation of said point element when the same is installed on the said adapter element, said lock means being rearward of said nose and socket, said adapter element being equipped with said nose forward of a relatively massive section and said point element being equipped with said socket, said lock means being positioned in said massive section, said interengaging parts including integral rearwardly-extending tongue means on said point element, said tongue means being shaped to receive a portion of said rod means.

7. The structure of claim 6 in which said adapter element is equipped with recess means for the receipt of said tongue means.

8. An excavating tooth comprising an adapter element and a point element, said adapter element having means at one end for connection to a bucket or the like and means at the other end for coupling to said point element, said point element having an earth engaging edge at one end constituting the tooth forward end and means at the other end for coupling to said adapter element, said coupling means including a nose on one element and a nose receiving socket on the other element, a plurality of cooperating generally helical thread means on said nose and in said socket whereby said point element is rotated to install the same on said adapter element, and lock means externally of said nose releasably connecting said elements to prevent reverse rotation of said point element when the same is installed on the said adapter element, said lock means including alignable projections and recesses on said elements external of said nose and socket to reduce shearing stresses, and pin means removably associated with said projections.

9. An excavating tooth comprising an adapter element and a point element, said adapter element having means in one end for connection to a bucket or the like and means at the other end for coupling to said point element, said point element having an earth engaging edge at one end and means at the other end for coupling to said adapter element, said coupling means including a threaded nose on one element and a nose receiving socket on the other element, lock means externally of said threaded nose releasably connecting said elements to prevent inadvertent disassembly of said elements, said lock means including tongues on one element and recesses on the other, and rod means interposed between said tongues and recesses and arranged to resist a disassembling force in compression.

10. The structure of claim 9 in which said rod means is a U-shaped fastener.

11. An excavating tooth point comprising a relatively elongated unitary element having a ground engaging edge at one end and means at the other end for coupling to an adapter, said coupling means including a plurality of thread means generally helically disposed about a longitudinally extending axis whereby said point is rotated to install the same on said adapter, and means on said point external of said axis for releasably locking said point on said adapter to prevent reverse rotation thereof, said coupling means including a tapered socket open at said other end and extending toward said one end, said locking means being positioned rearwardly of said socket, said locking means including rearwardly extending tongue means.

12. The structure of claim 11 in which said tongue means are contoured to receive rod means for locking said point to an adapter.

13. An excavating tooth point comprising a relatively elongated unitary element having a ground-engaging edge at the forward end thereof and a socket at the rear end for receipt of an adapter nose, said socket being forwardly convergent and including a surface of revolution generated about the longitudinally extending axis of said tooth point, said surface of revolution being interrupted at spaced apart areas by at least four helically disposed grooves, and means on said point rearward of said socket for releasably locking the same to an adapter to prevent rotational removal of said point from the adapter, said point having divergent working faces extending rearwardly from said ground-engaging edge and constituting the top and bottom faces of said tooth, said locking means including tongue means on the sides of said tooth extending rearwardly of said socket.

14. The structure of claim 13 in which said tongues are equipped with vertically extending groove means for the receipt of rod means.

15. An excavating tooth point comprising a relatively elongated unitary element having a ground engaging edge at one end and means at the other end for coupling to an adapter, said coupling means including a plurality of thread means generally helically disposed about a longitudinally extending axis whereby said point is rotated to install the same on said adapter, and tongue means for receiving pin means on said point external of said coupling means for releasably locking said point on said adapter to prevent reverse rotation thereof, said pin means being positioned relative to said axis so that incipient reverse rotation of said point element converts a stress that would normally shear a pin means on said axis to a compressive stress.

16. A tooth point comprising a unitary metal generally wedge-shaped body having a ground engaging end at the forward end thereof and a generally tapered socket extending forwardly from the rear end thereof, helical thread means in said socket for rotatably mounting said point on an adapter, and tongue means integral with said body extending rearwardly of said socket and equipped with groove means for receiving lock pin means.

17. An excavating tooth comprising an adapter element and a point element, said adapter element having means at one end for connection to a bucket or the like and means at the other end for coupling to said point element, said point element having an earth engaging edge at one end constituting the tooth forward end and means at the other end for coupling to said adapter element, said coupling means including a nose on one element and a nose receiving socket on the other element, a plurality of cooperating generally helical thread means on said nose and in said socket whereby said point element is rotated about a longitudinal axis to install the same on said adapter element, and lock means externally of said nose releasably connecting said elements to prevent reverse rotation of said point element when the same is installed on the said adapter element, said adapter element being equipped with said nose forward of a relatively massive section and said point element being equipped with said socket, said lock means being positioned in said massive section, said lock means includes interengaging parts on said point element and adapter element for receipt of locking rod means, said rod means being a generally U-shaped fastener having legs depending from a connecting bight, said adapter element being equipped with a transverse recess rearward of said nose for accommodating said bight of said U-shaped fastener, said legs being deformed intermediate the ends thereof, said interengaging parts including integral rearwardly-extending tongue means on said point element, each said tongue means being shaped to receive the deformed portion of a leg of said U-shaped fastener.

18. The structure of claim 17 in which each said tongue means is equipped with a slot for the receipt of its associated leg, said slot being sized to permit partial straightening of said deformed portion therein.

19. The structure of claim 18 in which each slot is equipped with a generally V-shaped rear wall to conform generally to the shape of said deformed portion.

20. An excavating tooth comprising an adapter element and a point element, said adapter element having means at one end for connection to a bucket or the like and means at the other end for coupling to said point element, said point element having an earth engaging edge at one end constituting the tooth forward end and means at the other end for coupling to said adapter element, said coupling means including a nose on one element and a nose receiving socket on the other element, a plurality of cooperating generally helical thread means on said nose and in said socket whereby said point element is rotated about a longitudinal axis to install the same on said adapter element, and lock means externally of said nose releasably connecting said element to prevent reverse rotation of said point element when the same is installed on the said adapter element, said adapter element being equipped with said nose forward of a relatively massive section and said point element being equipped with said socket, said lock means being positioned in said massive section, said nose and socket each being equipped in the apices thereof with generally planar bearing surfaces arranged generally perpendicular to the beam component of a force applied to said point element.

21. The structure of claim 20 in which said generally helical thread means extend into said apices and adjacent thread means flank each bearing surface.

22. The structure of claim 21 in which said thread means are non-uniform in transverse section in proceeding rearwardly therealong.

23. An excavating tooth comprising an adapter element and a point element, said adapter element having means at one end for connection to a bucket or the like and means at the other end for coupling to said point element, said point element having an earth engaging edge at one end constituting the tooth forward end and means at the other end for coupling to said adapter element, said coupling means including a nose on one element and a nose receiving socket on the other element, a plurality of cooperating generally helical thread means on said nose and in said socket whereby said point element is rotated about a longitudinal axis to install the same on said adapter element, and lock means externally of said nose releasably connecting said elements to prevent reverse rotation of said point element when the same is installed on the said adapter element, said nose and socket being equipped with apices having a general polygonal shape in transverse section to define a plurality of intersecting corners, said thread means extending generally along said corner.

24. The structure of claim 23 in which said apices are equipped with surfaces between said corners which merge into said thread means.

25. The structure of claim 23 in which said nose and socket rearward of said apices includes a surface of revolution generated about said axis, said surface of revolution extending from about 60% to 85% of the length of said nose and socket.

26. An excavating tooth comprising a point and adapter, said adapter at the rear end thereof having means for connection to excavating equipment and a nose at the forward end, said point having an earth-engaging edge at its forward end and a socket for receiving said nose at the rear end thereof, said point having tongues projecting rearwardly of said socket on opposite sides thereof, pin means connecting said tongues to said adapter, a plurality of cooperating generally helical thread means on said nose and in said socket whereby said point is rotatable about a longitudinal axis to install said point on said adapter, said pin means being spaced from said axis so as not to intersect the same, the apices of said nose and socket being generally polygonal in shape to provide beam bearings surfaces, the remainder of said nose and socket being a surface of revolution generated about said axis, said thread means extending into said apices generally at the corners of said polygonal shape.

27. An excavating tooth point comprising a relatively elongated unitary element having a ground engaging edge at one end and means at the other end for coupling to an adapter, said coupling means including a plurality of thread means generally helically disposed about a longitudinally extending axis whereby said point is rotated to install the same on said adapter, and means on said point external of said axis for releasably locking said point on said adapter to prevent reverse rotation thereof, said coupling means including a tapered socket open at said other end and extending toward said one end, said socket being equipped with an apex which is generally polygonal in section extending transverse to said axis to provide beam bearing surfaces, said thread means extending generally along the corner of said polygonal section, said polygonal section having at least four sides.

28. A tooth point comprising a unitary metal generally wedge-shaped body having a ground engaging end at the forward end thereof and a generally forwardly tapered socket extending forwardly from the rear end thereof, helical thread means in said socket for rotatably mounting said point on an adapter, and tongue means integral with said body extending rearwardly of said socket and equipped with slot means for receiving lock pin means, the apex of said socket being equipped with generally planar surfaces arranged generally perpendicular to the beam component of an applied force, said surfaces being flanked by said thread means.

29. The structure of claim 28 in which said slot means includes a rear wall contoured to receive a bent pin means.

30. The structure of claim 29 in which said rear wall contour is defined by rearwardly convergent generally planar areas.

31. The structure of claim 28 in which said tongues means are rearwardly tapered.

32. An excavating tooth point comprising a relatively elongated unitary element having a ground-engaging edge at the forward end thereof and a socket at the rear end for receipt of an adapter nose, said socket over the majority of its length being forwardly convergent from the rear end thereof and including a surface of revolution generated about the longitudinally extending axis of said tooth point, said socket being interrupted at spaced apart areas by at least four helically disposed grooves, rearwardly tapered tongue means on said point rearward of said socket for releasably locking the same to an adapter to prevent rotational removal of said point from the adapter, and stabilizing surface means at the forward end of said socket.

33. The structure of claim 32 in which said tongue means are equipped with vertically extending slot means for the receipt of rod means.

34. The structure of claim 32 in which said grooves are defined by a generally cylindrical envelope.

35. The structure of claim 32 in which said stabilizing means includes surfaces between said grooves at the apex of said socket, said grooves diminishing in cross-section in proceeding rearwardly.

* * * * *